US007749093B1

(12) United States Patent
Chang et al.

(10) Patent No.: US 7,749,093 B1
(45) Date of Patent: Jul. 6, 2010

(54) GOLF CLUB FACE ASSISTANCE DEVICE

(76) Inventors: Chia-Jen Chang, P.O. Box No. 6-57, Junghe, Taipei 235 (TW); Hao-Che Chang, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 12/481,187

(22) Filed: Jun. 9, 2009

(51) Int. Cl.
*A63B 69/36* (2006.01)

(52) U.S. Cl. ..... 473/226; 473/231

(58) Field of Classification Search ..... 473/219, 473/223, 226, 237, 227, 231, 238, 242, 244, 473/257, 261, 264, 265; D21/742, 733, 751, D21/759

See application file for complete search history.

(56) References Cited

U.S. PATENT DOCUMENTS 6,722,999 B1 * 4/2004 Yi ..... 473/238
6,872,149 B1 * 3/2005 Devon ..... 473/231
2005/0170902 A1 * 8/2005 Snowdon ..... 473/226

* cited by examiner

*Primary Examiner*—Nini Legesse
(74) *Attorney, Agent, or Firm*—Muncy, Geissler, Olds, & Lowe, PLLC

(57) ABSTRACT

The present invention discloses a golf club face assistance device. A proper location on a shaft of a club is provided with a first fixing element and is extended with a first assistance element. The other end of the first assistance element is connected with a second fixing element, and the first assistance element is provided with a second assistance element which is extended toward the shaft. An interface between the first and second assistance elements is defined with an aim point, and a virtual club face is defined from the aim point to the club face. By the virtual club face, one can easily learn a correct hitting form and a correct hit point.

6 Claims, 10 Drawing Sheets

GOLF CLUB FACE ASSISTANCE DEVICE

BACKGROUND OF THE INVENTION a) Field of the Invention

The present invention relates to an assistance device, and more particularly to a golf club face assistance device which is capable of training a correct form for hitting a golf ball and a correct hit point.

b) Description of the Prior Art

Golfing has gradually become a social activity in a modern society and is more and more popular in an ordinary life. However, for a beginner, to hit a golf ball accurately will require a period of time of practicing, and a fixed and accurate swing form is an important factor.

A good golf swing movement not only should control a direction of the ball, but also should be able to pay attention to a force, wherein in order to control the direction of the ball, a club head should swing on a right track and as long as that the ball is put on the most appropriate point on the track, the ball can fly toward a target. In addition, to hit the ball far, one will need to perfectly release the force that the force of whole body is focused on the ball at that appropriate point, such that the ball can be hit far and accurately.

An ordinary person will think it is so difficult to learn swinging a golf club is primarily due to that the swing track is invisible; therefore, people cannot always effectively control the club head on the correct track or cannot use the force correctly, resulting in that the ball which is hit is weak or flies randomly toward left or right. Furthermore, it is very difficult to stabilize the track even someone practices very hard on a driving range.

Three most important keys to help a golf player to stabilize the swing track and to pay attention to the force at a same time are fundamental movements, swing planes and release movements. As the swing track is invisible, nevertheless, people cannot always follow the aforementioned three points at a same time when swinging quickly.

Even being taught by a coach, it is most important that the player needs to practice repeatedly until he or she is familiarized. Yet, none of all the existing ordinary golf clubs is provided with a structure to assist the player in self practicing, which is unable to supplement insufficiency when the coach is not on a course. After being taught with the fundamental movements by the coach and when the beginner practices by oneself, he or she will not easily be aware of whether there is an error in swinging to adjust immediately. Hence, the beginner can always practice the incorrect forms. On the other hand, even the beginner records the swing forms to observe by oneself, he or she cannot adjust in time while swinging. Furthermore, as an ordinary club is a cylindrical shaft, it cannot be controlled easily, and because a club face area is too small, the difficulty in swinging is increased relatively.

SUMMARY OF THE INVENTION

The primary object of the present invention is to provide a golf club face assistance device, wherein a club is assembled with an assistance device, enabling a user to easily and quickly learn a correct swing form. The club is provided with a shaft and a club head, a side of the shaft is connected with a first fixing element which is extended with a first assistance element to adjust a club face angle when swinging, the other end of the first assistance element is connected with a second fixing element which is sheathed on the club head to facilitate fixing the two ends of the second fixing element, and a third fixing element is connected between the first fixing element and the club head of the shaft. The third fixing element is extended with a second assistance element which is connected with the first assistance element, and an interface between the first and second assistance elements is defined with an aim point. Therefore, when the user is to practice swinging, a swing angle of the club face can be adjusted by a parallel plane between the first assistance element and the club head, upon holding the shaft. Whereas, when parallel, the club face touches and squeezes a golf ball that the golf ball can fly out at the best angle. In addition, through the aim point, the golf ball can be located at the best position on the club face when hitting, such that a flying distance of the golf ball on the track can be optimized. By the aforementioned technologies, the issues existing in a prior art that as the swing track is invisible, one cannot always effectively control the club head on the correct track or cannot use the force correctly so that the ball which is hit is weak or flies randomly toward left or right, and even after being taught by the coach, one cannot easily find out there is any swinging error while practicing alone to adjust immediately that one may still always practice an incorrect form, are solved such that through the aforementioned structures, the golf club face assistance device of the present invention is able to help the user to keep the club face at the correct hitting direction and height at a same time when he or she swings, thereby providing the practical progressiveness of correcting the bad swing forms.

On the other hand, the club is in a cylindrical shape, but through the assistance device of the present invention, the club can be accurately controlled to stabilize the shaft and increase an area when hitting the ball. In addition, a virtual club face is defined from the aim point to the club face and through the virtual club face, an accuracy of hitting the ball (face-to-point hitting) can be increased, which also effectively solves the trouble that the ball cannot be hit correctly by swinging. Furthermore, the club of the present invention can be applied to any clubs and can be used in a field competition.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
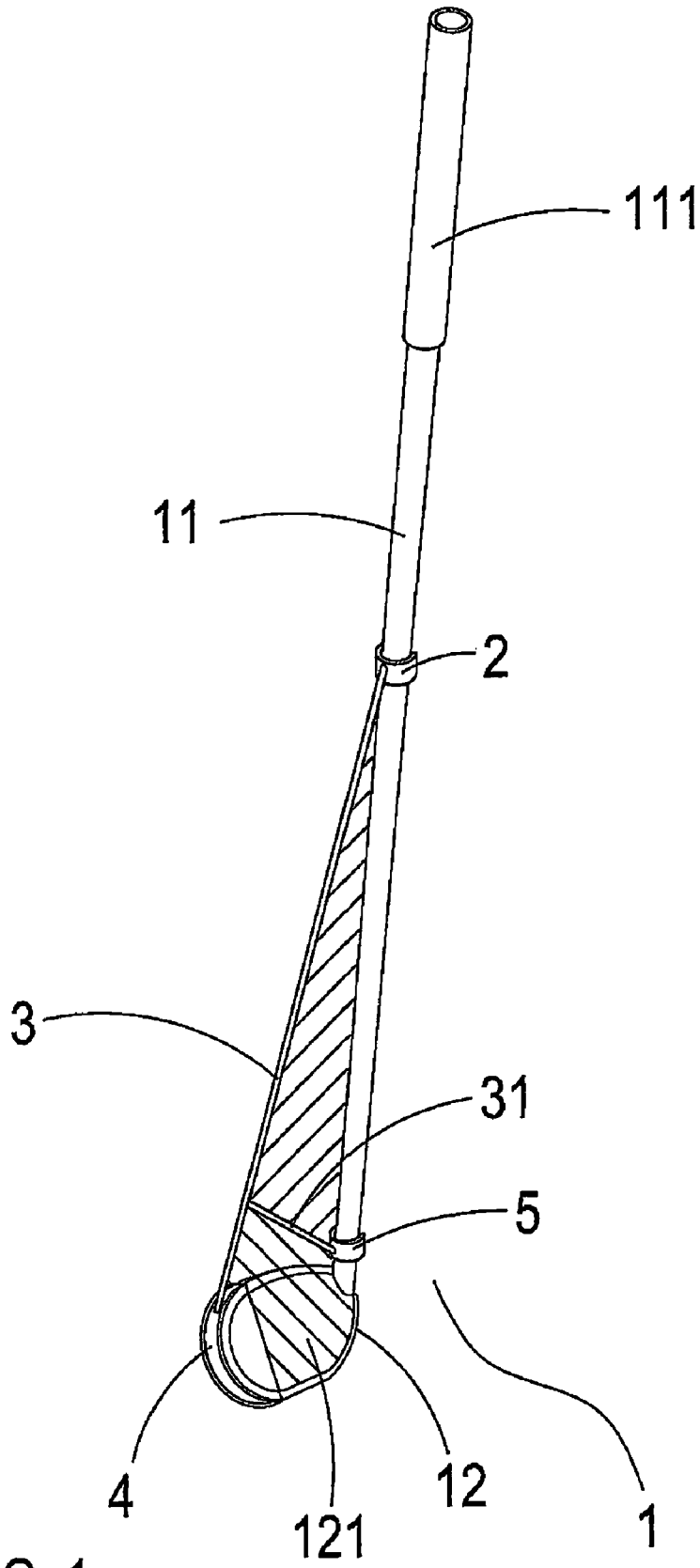
FIG. 1 shows a side view of a preferred embodiment of the present invention.
Figure 2:
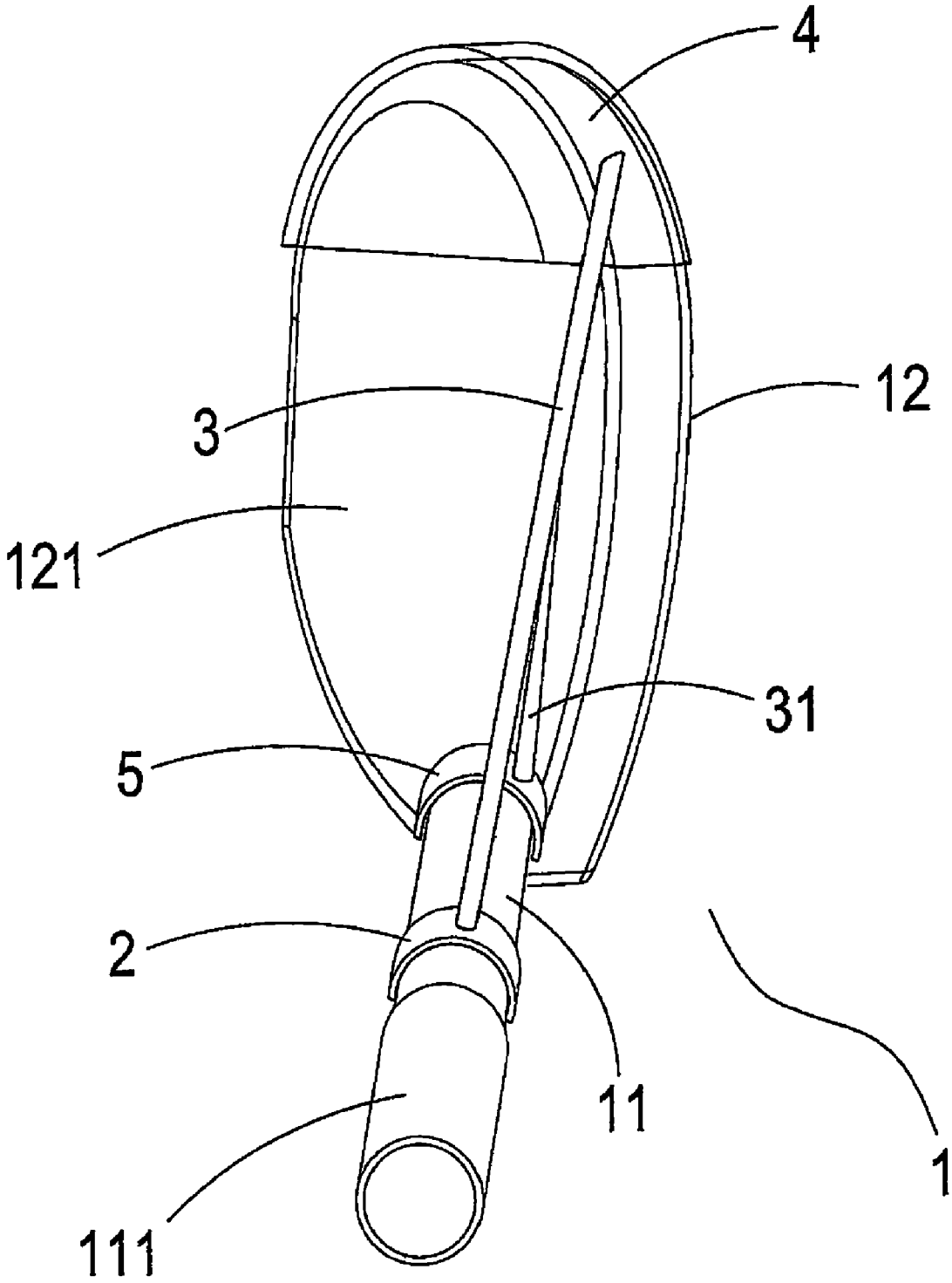
FIG. 2 shows a top view of a preferred embodiment of the present invention.

Referring to FIG. 1 and FIG. 2, it shows a side view and a top view of a preferred embodiment of the present invention. As shown in the drawings, the assistance device disclosed by the present invention is provided on a club 1 which includes a shaft 11 and a club head 12. An upper part of the shaft 11 is defined with a holding portion 111, and a side of the club head 12 is defined with a club face 121. The assistance device comprises primarily a first fixing element 2 which is connected at a side of the shaft 11 and is extended with a first assistance element 3, with the first fixing element 2 being fixed by clamping; a second fixing element 4 which is sheathed at the club head 12, is connected with one end of the first assistance element 3 and can be an assembly set being sheathed at a front end of the club head 12; and a third fixing element 5 which is connected between the first fixing element 2 and the club head 12, can be fixed by clamping and is extended with a second assistance element 31, an end of the second assistance element 31 far away from the third fixing element 5 being connected with the first assistance element 3.

Accordingly, through the aforementioned structures, a user is able to quickly, accurately and efficiently train swing forms and a correct hit point. In addition, unnecessary sport injuries can be avoided effectively. Besides, at a same time when the club face 121 hits a golf ball, the golf ball can be effectively located at the best position on the club face 121, so as to come out with the perfect ball track.

Figure 3:
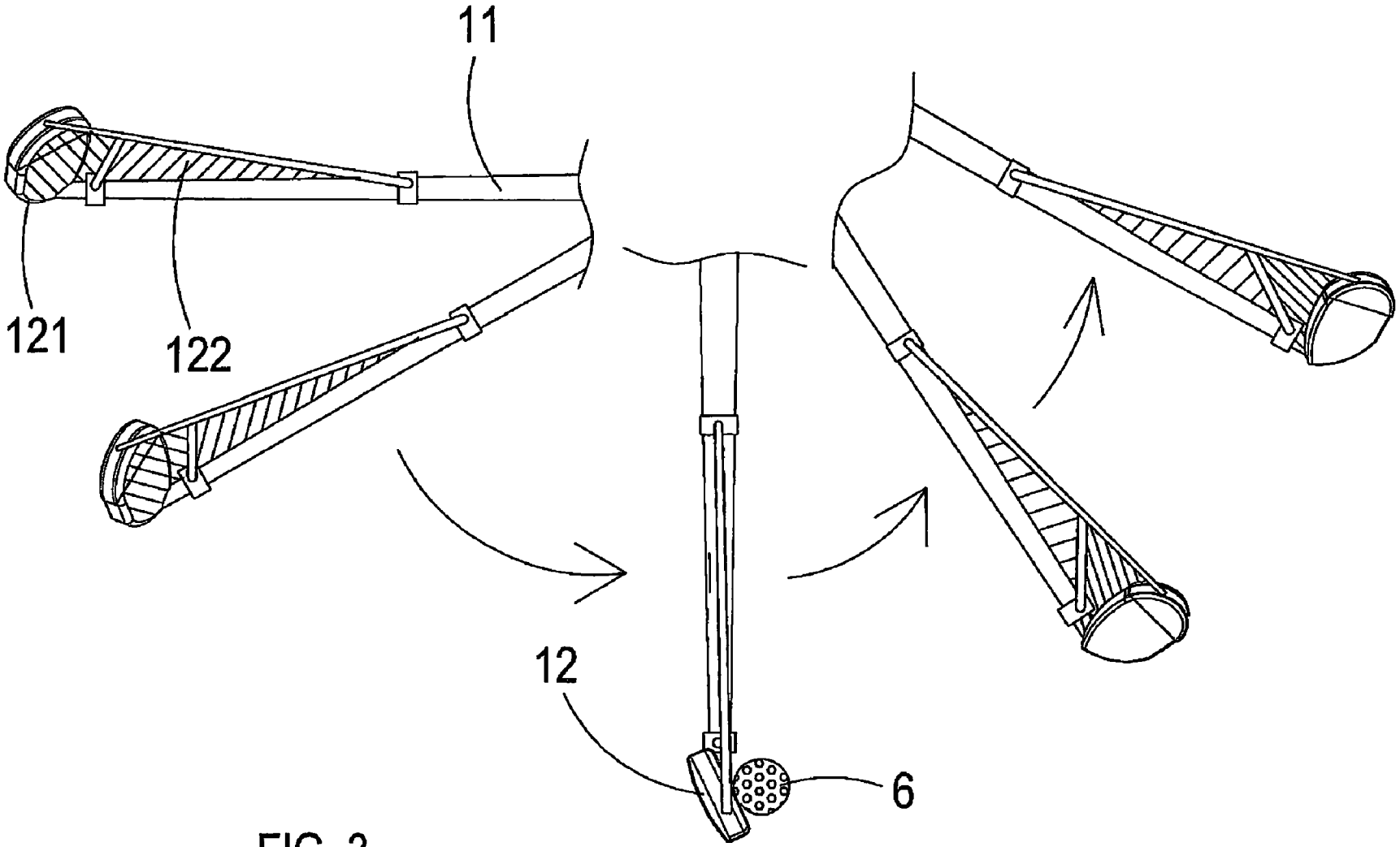
FIG. 3 shows a front view of a position of a correct swing angle of the present invention.
Figure 4:
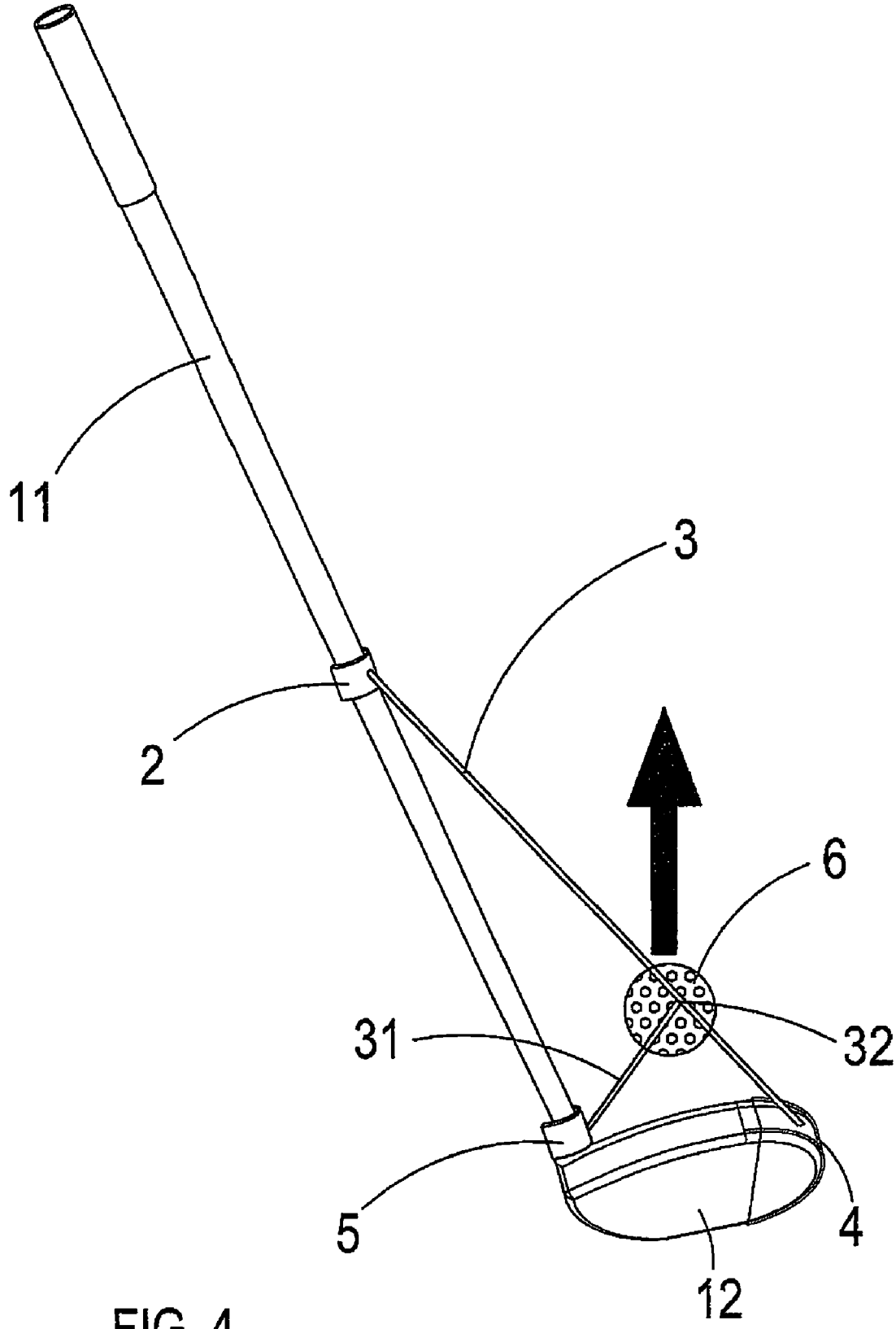
FIG. 4 shows a side view at a moment when hitting a golf ball of the present invention.

Referring to FIG. 3 and FIG. 4, it shows a front view of a position at a correct swing angle and a side view at a moment when hitting a golf ball, according to the present invention. As shown in the drawings, the first fixing element 2 is connected at a side of the shaft 11 and is extended with the first assistance element 3. The other end of the first assistance element 3 is connected to the second fixing element 4 which is sheathed at the front end of the club head 12, and a proper location of the first assistance element 3 is extended with the second assistance element 31, the other end of which is connected with the third fixing element 5. The third fixing element 5 is connected between the first fixing element 2 and the club head 12, and an interface between the first assistance element 3 and the second assistance element 31 is defined with an aim point 32 which constitutes a straight line with the best point on the club face 121 for hitting a golf ball 6 upon being viewed by the user. The first assistance element 3 provides the user to adjust an angle of the club face 121 at a moment when hitting the ball 6. When the first assistance element 3 is parallel with the club head 12, the club face 121 is at the perfect angle, enabling the user to swing a correct track at a moment when hitting the ball 6, such that through the aim point 32 and the first assistance element 3, the user can easily learn the swing forms and effectively learn the correct point for hitting the ball 6. In addition, sport injuries can be avoided.

Moreover, a virtual club face 122 is defined from the aim point 32 to the club face 121 to increase accuracy of hitting the ball 6 (hitting the ball 6 in a face-to-point way), and to effectively solve the trouble that the ball 6 cannot be hit accurately by swinging, as well.

Figure 5:
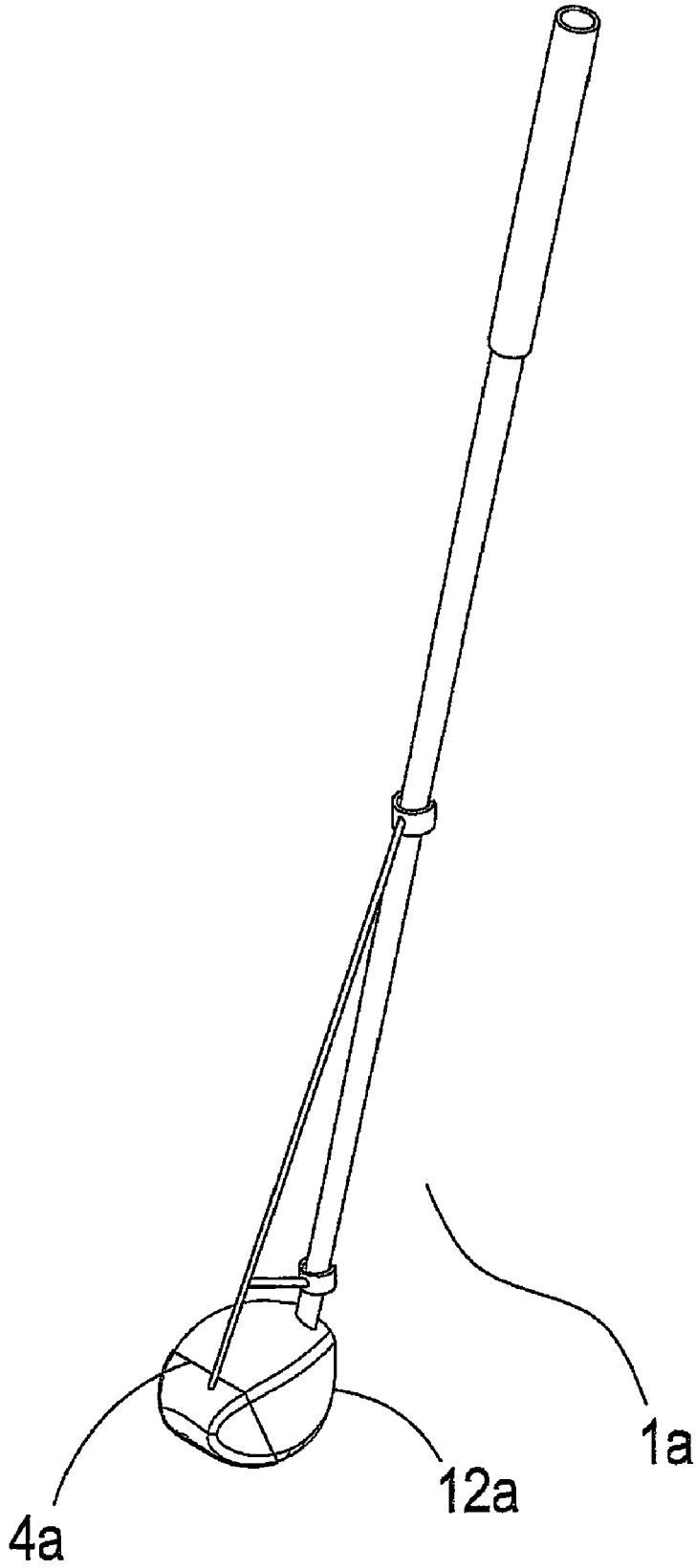
FIG. 5 shows a schematic view of an implementation of a first preferred embodiment of the present invention.

Referring to FIG. 5, it shows a schematic view of an implementation of a first preferred embodiment of the present invention. As shown in the drawing, a club 1*a* can be a No. 1 club 1*a* (driver club 1*a*). A bottom of the club 1*a* is provided with a club head 12*a*, a front end of which can be sheathed with a second fixing element 4*a*. Accordingly, the second fixing element 4*a* can be also sheathed on the club head 12*a* of the No. 1 club 1*a* (the second fixing element 4*a* is not limited to the aforementioned club 1*a*), so as to achieve an effect that the user can also learn the correct swing angle and form while driving the ball.

Figure 6:
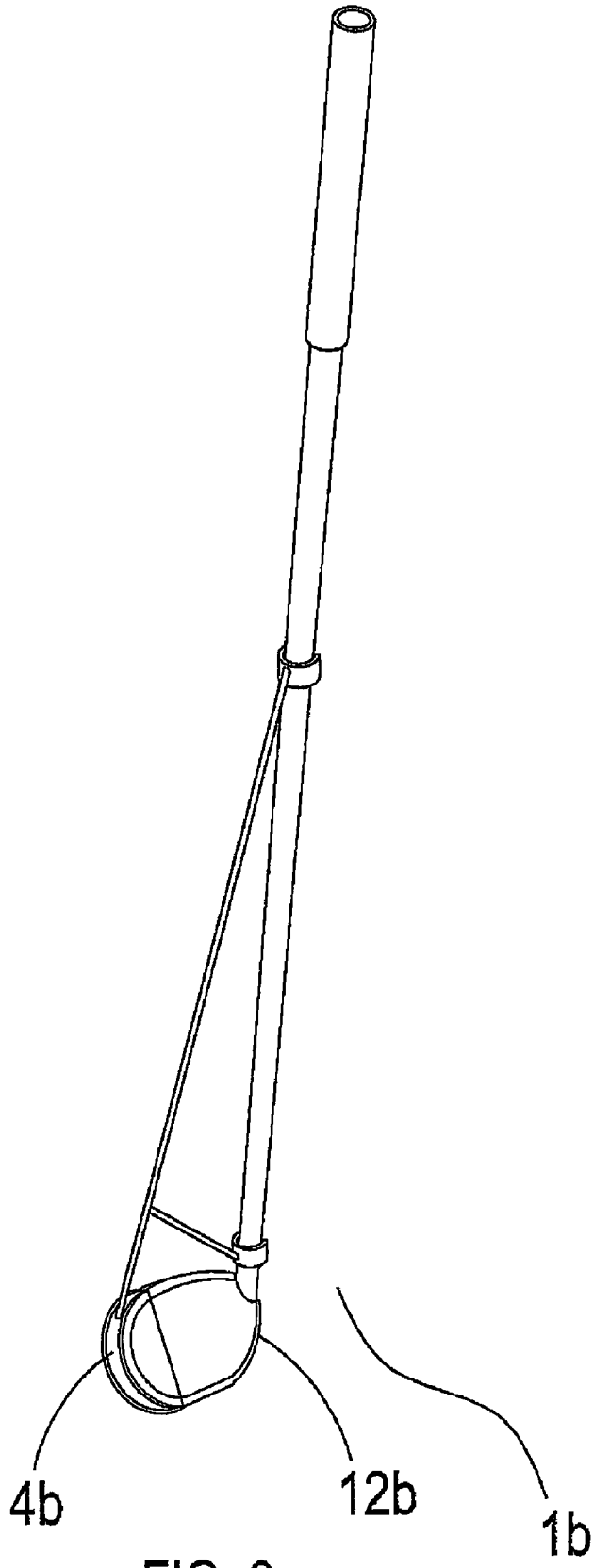
FIG. 6 shows a schematic view of an implementation of a second preferred embodiment of the present invention.

Referring to FIG. 6, it shows a schematic view of an implementation of a second preferred embodiment of the present invention. As shown in the drawing, a club 1*b* can be a No. 5 club 1*b* (fairway wood club). A bottom of the club 1*b* is provided with a club head 12*b*, a front end of which can be sheathed with a second fixing element 4*b*. Accordingly, the second fixing element 4*b* can be also sheathed on the club head 12*b* of the No. 5 club 1*b* (the second fixing element 4*b* is not limited to the aforementioned club 1*b*), so as to achieve an effect that the user can learn the correct swing angle and form upon hitting the ball on a green.

Figure 7:
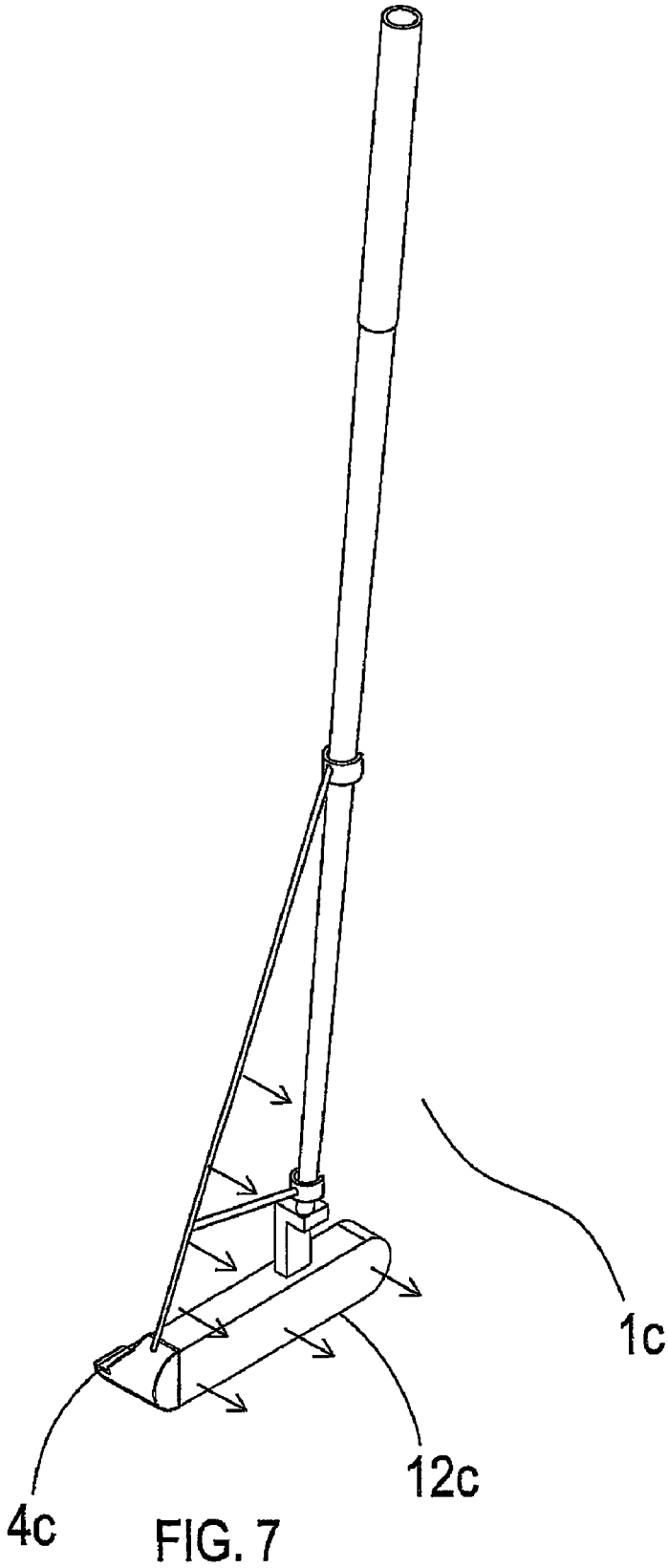
FIG. 7 shows a schematic view of an implementation of a third preferred embodiment of the present invention.
Figure 7A:
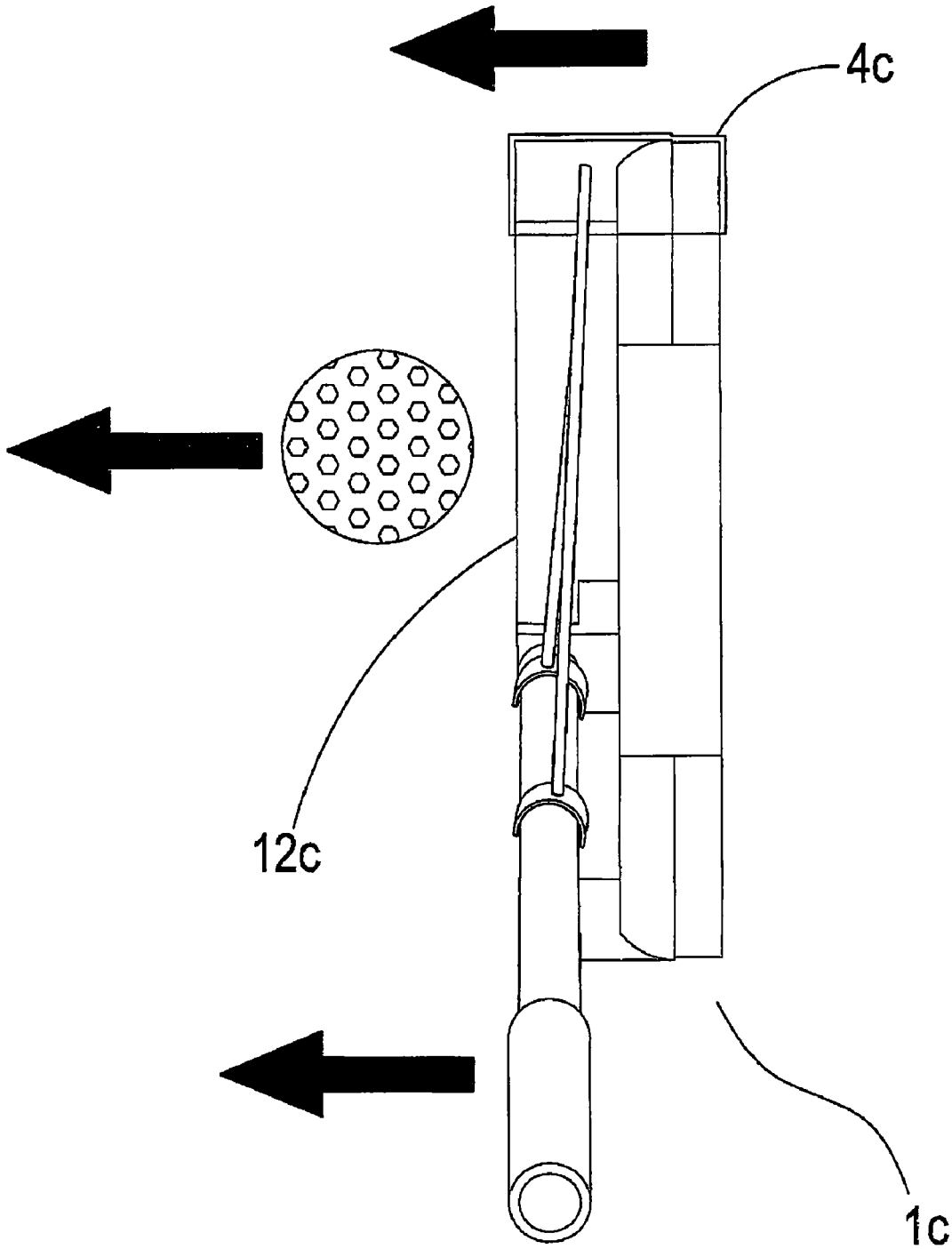
FIG. 7A shows a top view of the third preferred embodiment of the present invention.
Figure 7B:
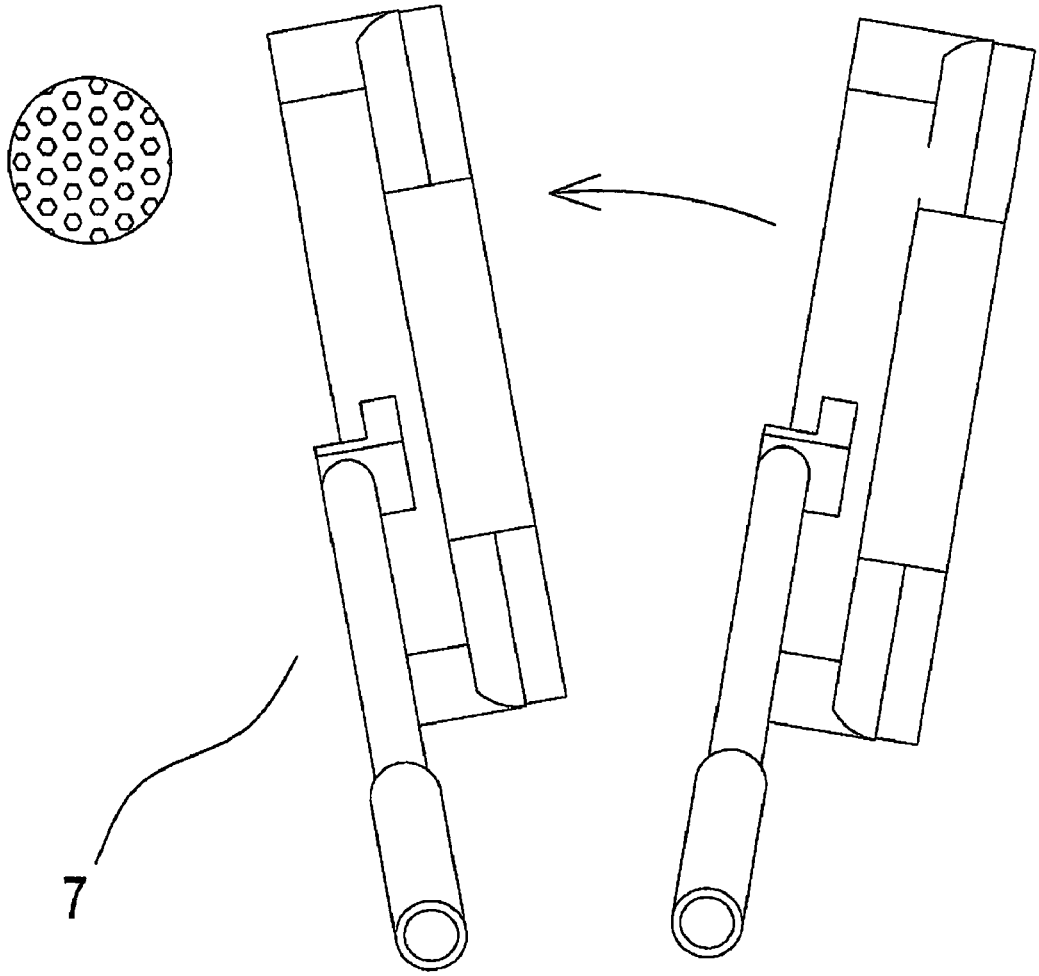
FIG. 7B shows a schematic view of a conventional putter club.

Referring to FIGS. 7, 7A and 7B, it shows a schematic view of an implementation and a top view of a third preferred embodiment of the present invention, as well as a schematic view of a conventional putter club. As shown in the drawings, a club 1*c* can be a putter club (green club). A bottom of the club 1*c* is provided with a club head 12*c*, a front end of which can be sheathed with a second fixing element 4*c*. Accordingly, the second fixing element 4*c* can be also sheathed on the club head 12*c* of the putter club (the second fixing element 4*c* is not limited to the aforementioned club 1*c*, either), so as to achieve an effect that the user can learnt the correct swing angle and form upon putting the ball into a hole. On the other hand, when the user swings, referring to FIG. 7A, it shows that when using the assistance device of the present invention to putt, the ball can be hit successfully and smoothly without resulting in an issue that at a moment of putting, the shaft will deviate from the correct swing angle. Moreover, comparing with FIG. 7B at a same time, it also shows a movement when using a conventional putter club 7 to swing. The conventional putter club 7 is not provided with the assistance device; therefore, when the ball has been putted out, the shaft will easily deviate from the correct track, allowing the ball not to move toward a correct path.

Figure 8:
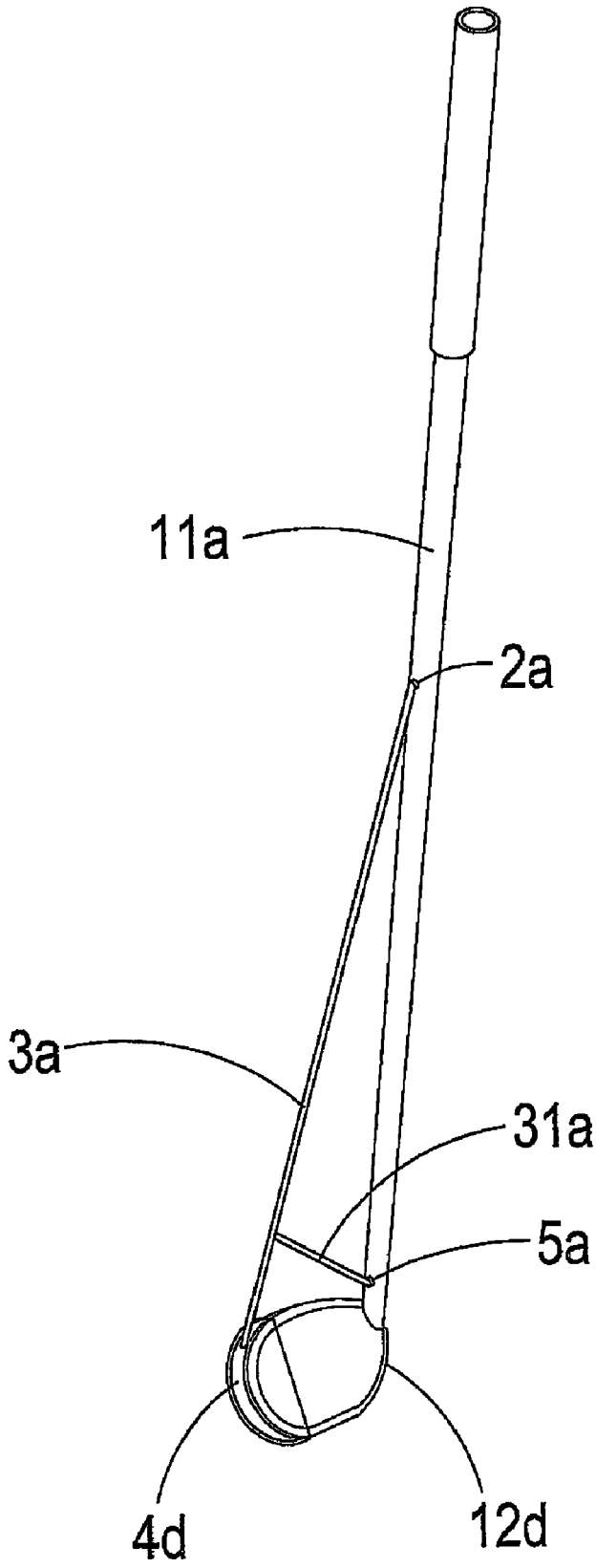
FIG. 8 shows a schematic view of an implementation of another preferred embodiment of the present invention.

Referring to FIG. 8, it shows a schematic view of an implementation of another preferred embodiment of the present invention. As shown in the drawing, a shaft 11*a* is connected with a first fixing element 2*a* which can be fixed by adhesive or magnetically. A third fixing element 5*a* can be also fixed by adhesive or magnetically, and a club head 12*d* at a bottom of the shaft 11*a* is sheathed with a second fixing element 4*d*. A first assistance element 3*a* is connected between the first fixing element 2*a* and the second fixing element 4*d*, and can be a wiring material, a rubber material or iron. In addition, a proper location of the first assistance element 3*a* is provided with a second assistance element 31*a* which is extended toward the shaft 11*a*. The second assistance element 31*a* can be a wiring material, a rubber material or iron. Accordingly, the first assistance element 3*a* and the second assistance element 31*a* can all be connected on the shaft 11*a* by various fixing methods and are all not limited to the aforementioned materials.

As a result, the key technologies of the present invention to improve the prior art are that:

1. The correct form, direction and height for hitting the ball 6 can be kept, so as to accurately accomplish hitting the ball 6.
2. The bad swing plane and form can be corrected effectively, and a gross can be effectively decreased.
3. A head can be kept at a good form when hitting the ball 6, and the angle of club face 121 can be checked for accuracy when hitting the ball 6, so as to reduce lifting up the head and making an error.

4. Accuracy of a back swing plane, a down swing plane and a follow-through plane can be checked.
5. One can easily learn a circumferential swing movement when hitting and can learn it through quickly.
6. The correct swing method can be learned when swinging at a high angle, and sport injuries can be decreased.
7. The correct point to hit the ball 6 can be learned effectively, which reduces a condition that when swinging, the club 1 may be low or high, thereby hitting the perfect path.
8. As wind resistance is increased, delay of down swing can be produced, thereby increasing an effect of centrifugal force.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A golf club face assistance device, which is provided on a club having a shaft and a club head, comprising:

a first fixing element which is connected at a side of the shaft and is extended with a first assistance element;

a second fixing element which is provided at the club head and is connected with an end of the first assistance element; and a third fixing element which is connected to the shaft between the first fixing element and the club head, and is extended with a second assistance element, an end of the second assistance element far away from the third fixing element being connected with the first assistance element at a point between the first and second fixing elements.

2. The golf club face assistance device according to claim 1, wherein the first fixing element is fixed by clamping, adhesive or magnetically.

3. The golf club face assistance device according to claim 1, wherein the second fixing element is an assembly set.

4. The golf club face assistance device according to claim 1, wherein the first assistance element is made by a wiring material, a rubber material or iron.

5. The golf club face assistance device according to claim 1, wherein the third fixing element is fixed by clamping, adhesive or magnetically.

6. The golf club face assistance device according to claim 1, wherein the second assistance element is made by a wiring material, a rubber material or iron.

* * * * *